United States Patent [19]

Howell

[11] 4,183,109

[45] Jan. 15, 1980

[54] SECTIONAL BED

[76] Inventor: William H. Howell, Texas Tower, Houston, Tex. 77002

[21] Appl. No.: 898,788

[22] Filed: Apr. 21, 1978

[51] Int. Cl.[2] ..... A47C 3/32; A61G 7/10

[52] U.S. Cl. ..... 5/60; 5/68; 5/86; 297/DIG. 10

[58] Field of Search ..... 5/60, 66–68, 5/86; 297/316, 354, 373, 377, DIG. 10

[56] References Cited

U.S. PATENT DOCUMENTS

| | | | |
|---|---|---|---|
| 2,778,408 | 1/1957 | Krikorian | 297/316 |
| 3,138,805 | 6/1964 | Riazza | 5/60 |
| 3,239,853 | 3/1966 | MacDonald | 5/68 |
| 3,353,193 | 11/1967 | Greiner | 297/354 |
| 3,989,297 | 11/1976 | Kerstholt | 297/355 |

*Primary Examiner*—Casmir A. Nunberg
*Attorney, Agent, or Firm*—Ranseler O. Wyatt

[57] ABSTRACT

A bed for use in hospitals, and the like, wherein a patient may be moved to a sitting position, with the head portion of the bed raised and the foot portion of the bed lowered, the bed being in three sections and pivotal to permit the foot section to be swung outwardly so that the feet of the patient may be lowered to a natural sitting position.

6 Claims, 4 Drawing Figures

SECTIONAL BED

BACKGROUND OF THE INVENTION

Hospital beds are normally adjustable at the head and foot, and though the head section can be elevated, it will not reach the full upright position, while the foot section can not be lowered without an upward swing at the hip-knee portion. In such a bed, where a patient has recently suffered a myocardial infarction, such patient is required to remain flat on their back, because such bed will not help the patient assume a full sitting position. It is a well documented fact that an individual in a full sitting position consumes less energy than in the lying down position. It is also a fact that an individual consumes about double the amount of calories during bowel movement lying down than when in the sitting position. It is an object of this invention to provide means for shifting the position of such patient from the lying down to the sitting position, without avoidable strain or load to the heart and will, by permitting a full sitting position, unload the heart by utilizing the abdomen and leg's natural pool of accumulated blood in such position and will assist in providing the best position for minimum energy expenditure. Means for relieving the unnecessary load on the heart is one of the present problems of post myocardial infarction in early rehabilitation of the patient in post stroke, hemiplegia, arthritic, elderly, etc., without unnecessary load or strain on the patient's back, or other vital organ.

SUMMARY OF THE INVENTION

A hospital bed having means for lowering and raising the patient from prone to sitting position, or a selective position therebetween, having hinged sections adapted to be raised off of a rigid frame, and having means for vertical adjustment of the head and foot sections, and means for rotating the bed so that the patient may be placed in a sitting position transversely of the bed, with the foot section extended beyond the side member of the frame and beneath the end of the said mid-section.

DESCRIPTION OF THE PREFERRED EMBODIMENT

Figure 1:
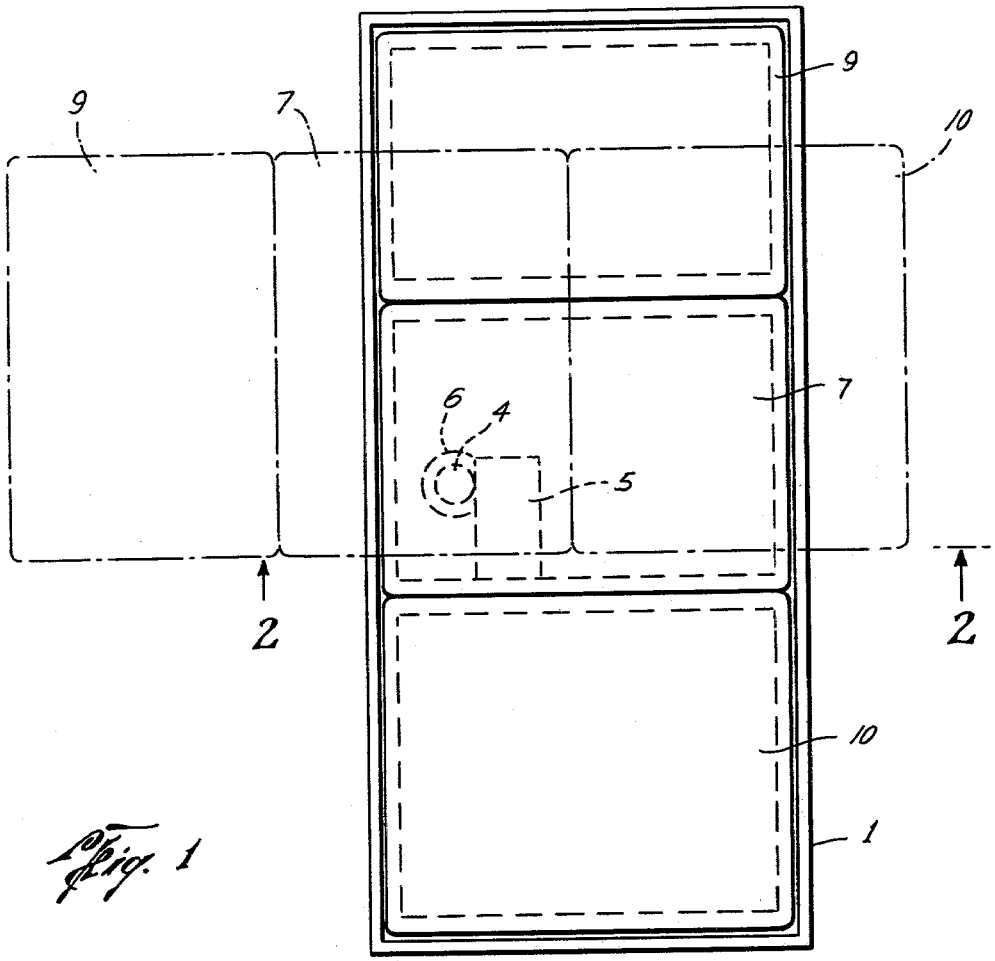
FIG. 1 is a top plan view of the bed, showing the positioning transversely of the frame, in dotted lines.
Figure 2:
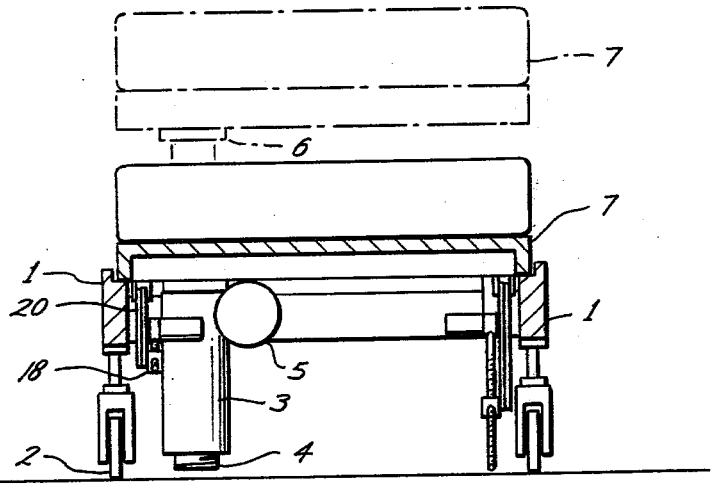
FIG. 2 is an end view, in cross section, taken on the line 2—2 of FIG. 1.
Figure 3:
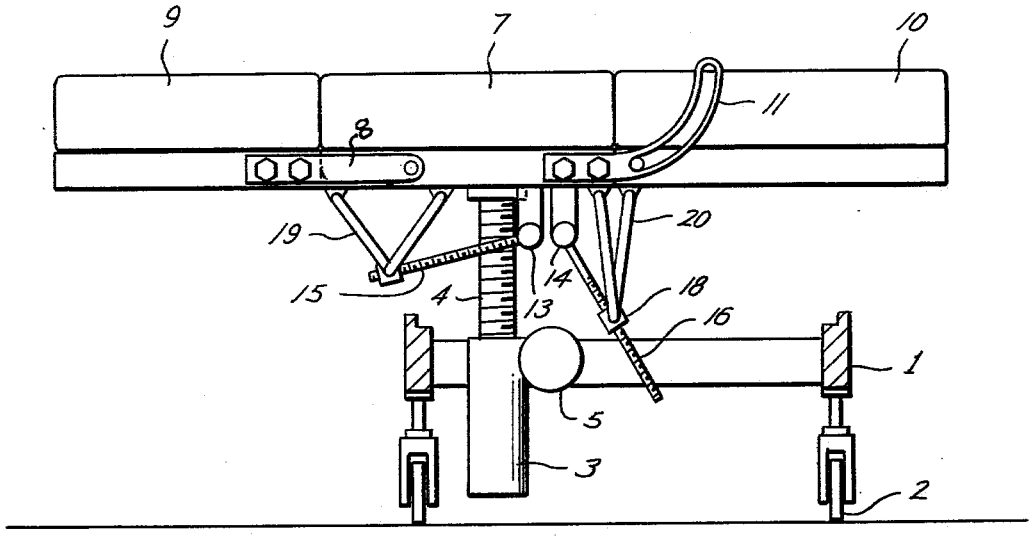
FIG. 3 is a side elevational view, partially in cross section, showing the bed moved to a position transverse of the frame.
Figure 4:
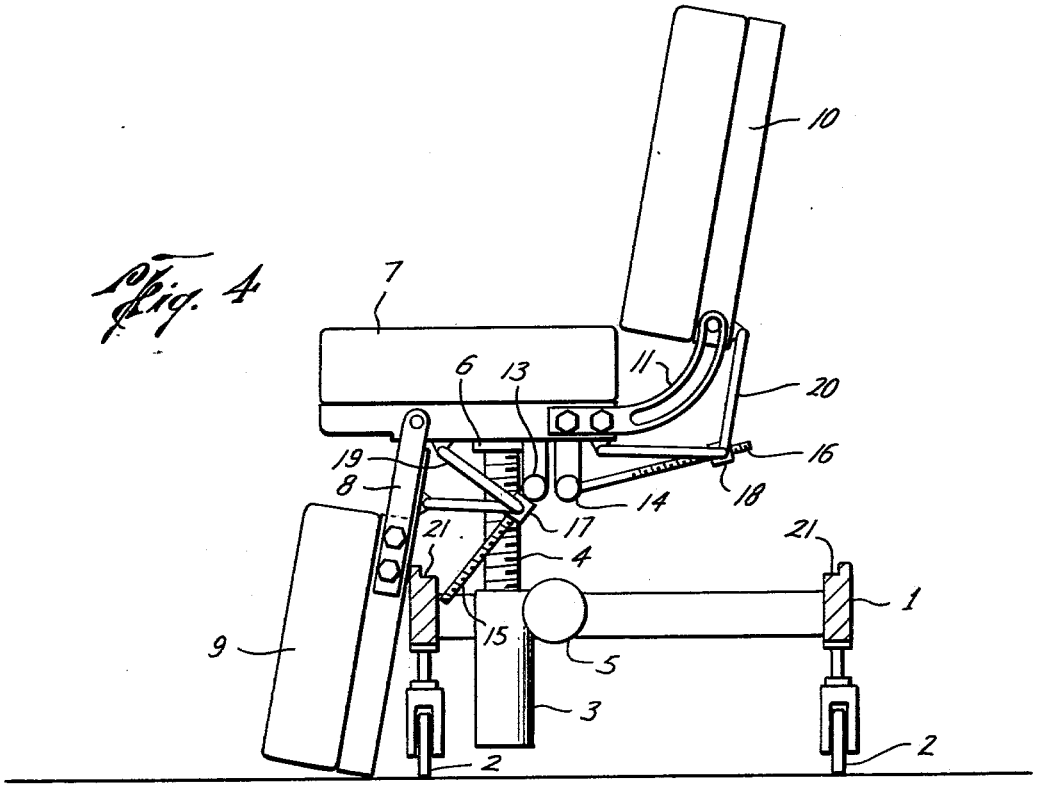
FIG. 4 is a side elevational view of the bed, partially in cross section, showing the bed moved to a position to permit the patient to assume a full sitting position.

In the drawings, the numeral 1 designates a bed frame having the usual castors 2, 2. An internally threaded housing 3 is mounted on the frame, positioned adjacent one side bar thereof, and midway of the ends of the frame and the externally threaded shaft 4 reciprocates in said housing, and may be actuated by a suitable motor 5. The extended end of the shaft 4 has a pivotal mount 6 which is secured to the bottom surface of the central surface of the central section 7. The section 7 is hinged by a suitable hinge 8, one mounted on each side of the section 7 and the adjacent side of the foot section 9. The head section 10 is pivotally connected to the mid section

7 by the upwardly curved slotted supports as 11, mounted on each side of the mid section 7, and the pins, as 12, which are mounted in the head section 10, and extend outwardly therefrom, fit in the slots of the supports 11, which guide the position of the head section 10. Motors 13, 14 rotate the externally threaded shafts 15, 16 on which the followers 17, 18 are mounted; pivotal supports 19, 20 are mounted at one end on the respective followers 17, 18 and at the other end on the respective sections 9 and 10.

When it is desired to place a patient in a sitting position, the sections 7, 9, 10 are raised by means of the motor 5 and shaft 4 until clear of the frame 1, and the bed is then rotated to swing the sections into a position transversely of the frame, the foot section 9 will be positioned outwardly from the frame by means of the shaft 4 being located at one side, rather than the middle area between side members of the frame, and the sections may then be actuated by the motors 13, 14 to raise the head section 10 and lower the foot section 9 until the upper end of the section 9 is between the adjacent end of the mid section 7 and the patient is in full sitting position; any degree of full sitting position desired included, thus permitting the therapeutic advantages of a sitting position without loading the spine. Further by moving the patient to the full sitting position, when it is desired to assume a full standing position, this may easily be done without strain on the spine.

When the patient needs to resume prone position, the motors are activated to swing the head section and the foot section into horizontal position, and the sections rotated on the mount 6 until they are aligned with the side members of the framework, and the motor 5 activated to lower the three sections on to the frame 1. Shouders 21, 21 on the side members retain the three sections against rotation while seated on the said side members.

What I claim is:

1. In a bed, a rigid rectangular frame, a sectional spring and mattress pivotally mounted on said frame, means for elevating said sectional spring and mattress and means for selectively adjusting the position of the sections and means for pivoting the sections from longitudinal to transverse relative to the frame, said means for selectively adjusting the position of the sections being mounted on the rigid rectangular frame adjacent one side member thereof and midway between the ends of said rectangular frame.

2. The device defined in claim 1 wherein said sections consist of a mid-section, a foot section and a head section, said means of selectively adjusting the position of the sections having motor driven, externally threaded, shafts, followers on said shafts and pivotal bars connected to said respective followers at one end and to the respective head and foot sections at the other end.

3. The device defined in claim 1 wherein said sections consist of a mid-section and a foot and head section, respectively, said foot section being hinged on its side face to the adjacent side face of the said mid section, and having motor driven means for positioning said foot section relative to said mid-section.

4. The device defined in claim 1 wherein said mid-section has slotted, upwardly curved supports mounted on each side at the end adjacent the edge section, pins extending outwardly from each side of the head section and adapted to ride in the slots in said slotted supports, and motor driven means for selectively positioning said sections relative to said midsection.

5. The device defined in claim 1 wherein said elevating means having a pivotal connection with said section, will permit rotation of said sections relative to said frame to a position transversely of said frame, and positioning said foot section laterally of the said frame and beyond the adjacent side member of the frame.

6. The device defined in claim 5 wherein said foot section will move into a vertical position beneath said mid-section at one extreme and into horizontal alignment with said mid-section at the other extreme.

* * * * *